US005792527A

United States Patent [19]

Yoshimitsu et al.

[11] Patent Number: 5,792,527

[45] Date of Patent: Aug. 11, 1998

[54] PRODUCTS IN A CONTINUOUS LENGTH FORMED FROM FIBER-REINFORCED RESIN AND PROCESS FOR PREPARING THE SAME

[75] Inventors: Minoru Yoshimitsu; Rikio Yonaiyama; Nobukazu Atsumi, all of Ichihara, Japan

[73] Assignee: Chisso Corporation, Osaka, Japan

[21] Appl. No.: 600,968

[22] PCT Filed: Jun. 13, 1995

[86] PCT No.: PCT/JP95/01182

§ 371 Date: Feb. 14, 1996

§ 102(e) Date: Feb. 14, 1996

[87] PCT Pub. No.: WO95/35199

PCT Pub. Date: Dec. 28, 1995

[30] Foreign Application Priority Data

Jun. 17, 1994 [JP] Japan ..... 6-159596

[51] Int. Cl.[6] ..... B29D 22/00; B29D 23/00

[52] U.S. Cl. ..... 428/36.1; 523/348; 524/492; 524/493; 524/494; 428/902

[58] Field of Search ..... 523/348; 524/494, 524/495, 496, 514, 515; 264/211, 211.23, 331.15, 331.16; 428/36.1, 375, 376, 378, 398, 400

[56] References Cited

U.S. PATENT DOCUMENTS

| | | | |
|---|---|---|---|
| 4,613,647 | 9/1986 | Yonaiyama et al. | 524/514 |
| 5,133,316 | 7/1992 | Kasai et al. | 123/198 E |
| 5,238,989 | 8/1993 | Takei et al. | 524/449 |
| 5,264,174 | 11/1993 | Takei et al. | 264/211.23 |

FOREIGN PATENT DOCUMENTS

| | | |
|---|---|---|
| 1-192946 | 8/1989 | Japan . |
| 3-026531 | 2/1991 | Japan . |
| 4-082717 | 3/1992 | Japan . |
| 4-105927 | 4/1992 | Japan . |

*Primary Examiner*—Vasu Jagannathan
*Assistant Examiner*—U. K. Rajguru
*Attorney, Agent, or Firm*—Leydig, Voit & Mayer, Ltd.

[57] ABSTRACT

A product is provided in a continuous length formed from a fiber-reinforced resin and having a shape ratio [whole length of the contour of the section (Lmm)/real area of the section ($Smm^2$)] of 0.5 to 2.5/mm and a thickness of 1 to 4 mm. This product in a continuous length is prominently excellent in tensile strength, though the amount of the fiber reinforcement contained in the product is almost the same as in conventional fiber-reinforced products. Hence, the product in a continuous length is favorably used as a spacer for concrete form.

33 Claims, 4 Drawing Sheets

1
11
11a
11b
12
12a
12b
12c
12e
12r
IB
IC

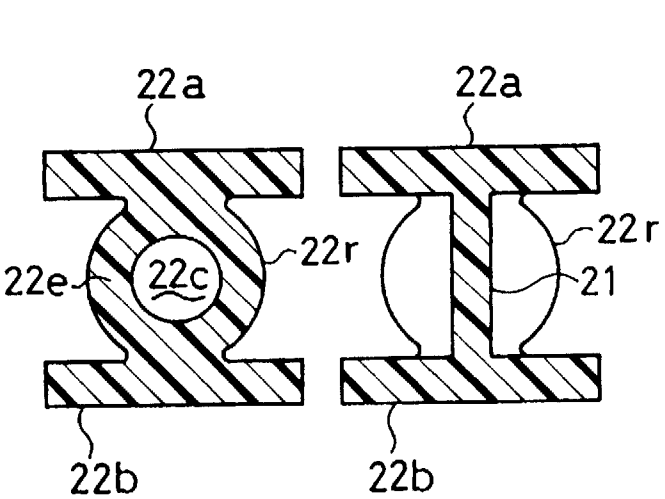
Fig. 2B
Fig. 2C
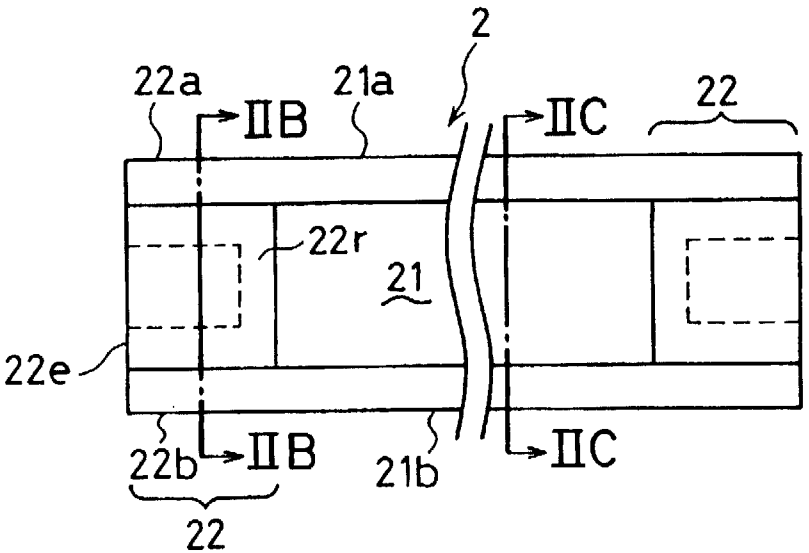
Fig. 2A

PRODUCTS IN A CONTINUOUS LENGTH FORMED FROM FIBER-REINFORCED RESIN AND PROCESS FOR PREPARING THE SAME

TECHNICAL FIELD

The present invention relates to a product in a continuous length (hereinafter sometimes referred to as a "continuous-length product") formed from a resin reinforced with a fiber reinforcement, a process for preparing the same and uses of the same. More particularly, the invention relates to a fiber-reinforced continuous-length product in a specific shape and excellent in tensile strength, which is formed from a reinforced resin composition comprising a resin matrix of a thermoplastic resin (e.g., a crystalline polyolefin resin, a polyamide resin (nylon) or a specific composition of both resins) or a thermosetting resin as a base resin, and a fiber reinforcement, particularly a glass fiber reinforcement. The invention also relates to a process for preparing the continuous-length products.

Moreover, the invention relates to a spacer in a continuous length capable of keeping opposite panels of a concrete form at a given distance when fit inside the panels and capable of maintaining the given distance while withstanding great tensile stress applied during the setting period of the concrete placed between the panels.

BACKGROUND ART

For forming a structure of prescribed shape from cement plaster, cement, concrete, etc. (sometimes referred to as "concrete or the like" hereinafter), generally adopted is such a technique that a concrete form surrounding a space of shape corresponding to the housing of the structure is set up and concrete or the like is placed in the space. In this technique, plates (form panels) made of steel, light metal, wood or plastic (resin) are used to build the form.

In the form built of the form panels, it is required that not only the adjacent form panels are fixed to each other at their corners, side edges or ridges, but also the opposite form panels are fixed at plural positions with a spacer, in order to keep the panels, which face each other via the space for placing the concrete therein, at a given distance. The reason is that the action of the concrete or the like placed in the spacer to push the form outward cannot be restrained only by fixing the form panels at their corners, side edges or ridges. The concrete or the like is a heavy fluid before setting, and it is swollen hen set. Therefore, the force of the concrete or the like to push the form outward is very great. To withstand the strong outward force, the spacer needs to have high tensile strength, but its own weight is desired to be small.

It is, therefore, an object of the invention to provide a continuous-length product which is reinforced with a fiber material, thereby exhibiting high tensile strength, particularly to provide a spacer which is useful for concrete forms and satisfies such two requirements that the spacer sufficiently withstands the outwardly strong tensile stress and the spacer's own weight is as light as possible and the amount of the material used for the spacer is as small as possible.

DISCLOSURE OF THE INVENTION

The continuous-length product according to the present invention is characterized in that the continuous-length product is formed from a fiber-reinforced resin comprising a fiber reinforcement and a resin matrix and has a shape ratio

|whole length of the contour of the section (Lmm)/real area of the section ($Smm^2$)| of 0.5 to 2.5/mm, preferably 0.55 to 2.2/mm, and a thickness of 1 to 4 mm, preferably 1.5 to 3.5 mm.

The continuous-length products of the invention may be in any shape satisfying the above-defined shape ratio, and its sectional shape is, for example, X shape (+shape), H shape, ⅊ shape, * shape, circular ring shape or polygonal ring shape.

In the continuous-length products of the invention, the fiber reinforcement is preferably dispersed and contained in the resin matrix in such a manner that the fiber reinforcement is arranged substantially in parallel with the major axis of the continuous-length product in at least the surface portion (layer) of the continuous-length products.

The fiber reinforcement used in the invention has a mean fiber length of preferably 0.3 to 30 mm, more preferably 3 to 30 mm. The fiber reinforcement is desirably contained in the continuous-length product in an amount of 15 to 50% by weight, preferably 20 to 40% by weight.

The fiber reinforcement used in the invention may be any one of inorganic fiber, organic fiber and carbon fiber, and particularly preferred is a hard glass fiber having a mean fiber diameter of 3 to 21 μm, a tensile strength of not less than 20.5 MPa and a tensile modulus of not less than 725 MPa.

The resin matrix used in the invention may be any one of a thermoplastic resin and a thermosetting resin. The resin matrix is preferably a crystalline thermoplastic resin. Examples of the crystalline thermoplastic resins include a crystalline polyolefin resin, a polyamide resin and a composition of both resins. When the resin matrix is a non-blended crystalline polyolefin resin or a composition of said crystalline polyolefin resin with other thermoplastic resin, the crystalline polyolefin resin is preferably a polyolefin resin having been at least partially modified with maleic anhydride and is preferably contained in an amount of 10 to 30% by weight based on the resin matrix.

When the crystalline polyolefin resin is a crystalline propylene homopolymer, a crystalline propylene-α-olefin copolymer, e.g., a crystalline ethylene-propylene copolymer, or a mixture of these polymers, it desirably has MFR (230° C., 2.16 kgf) of not less than 10 g/10 min and a crystalline melting point (Tm) of 160° to 170° C.

Examples of the polyamide resins used as the thermoplastic resins in the invention include ring-opening addition polymerization nylons such as 6-nylon, 7-nylon, 11-nylon and 12-nylon, copolycondensation nylons such as 6,6-nylon, 6,7-nylon, 6,10-nylon and 6,12-nylon, and xylylenediamine-lower aliphatic dicarboxylic acid copolycondensation nylons.

Further, the resin matrix used in the invention is particularly desirably a resin composition comprising 50 to 75% by weight, preferably 53 to 71% by weight, of a polyamide resin and 50 to 25% by weight, preferably 47 to 29% by weight, of a crystalline polyolefin resin (total amount: 100% by weight) and having a crystallization equilibrium time of 300 to 550 sec, preferably 350 to 420 sec.

The injection molding process for forming a continuous-length product according to the invention is characterized in that the process comprises introducing a molten fiber-reinforced resin containing 85 to 50% by weight of the matrix resin and 15 to 50% by weight of the fiber reinforcement having a length of 0.3 to 30 mm (total amount: 100% by weight) into a continuous-length mold in such a manner that the molten fiber-reinforced resin is fed along the major axis of the mold.

The continuous-length product according to the invention is favorably used for various purposes, particularly as a spacer for concrete form. The spacer of the invention has a long and narrow body and bolt holes provided on both side ends of the body. The spacer satisfies the above-defined shape ratio and thickness of the continuous-length product of the invention. In the spacer, moreover, the fiber reinforcement is dispersed and contained in the resin matrix in such a manner that the fiber reinforcement is arranged substantially parallel to the major axis of the spacer in at least the surface portion of the spacer.

BRIEF DESCRIPTION OF THE DRAWINGS

FIG. 2A is a schematic side view of another embodiment of the spacer for concrete form according to the present invention.

FIG. 2B is a sectional view taken in the direction of the arrows along the line IIB—IIB of FIG. 2A.

FIG. 2C is a sectional view taken in the direction of the arrows along the line IIC—IIC of FIG. 2A.

In FIG. 3, the component ratio between a polyamide resin and a specific modified crystalline polyolefin resin is plotted as abscissa axis, and the crystallization equilibrium time is plotted as an ordinate axis.

BEST MODE FOR CARRYING OUT THE INVENTION

Figures 1A, 1B, 1C:
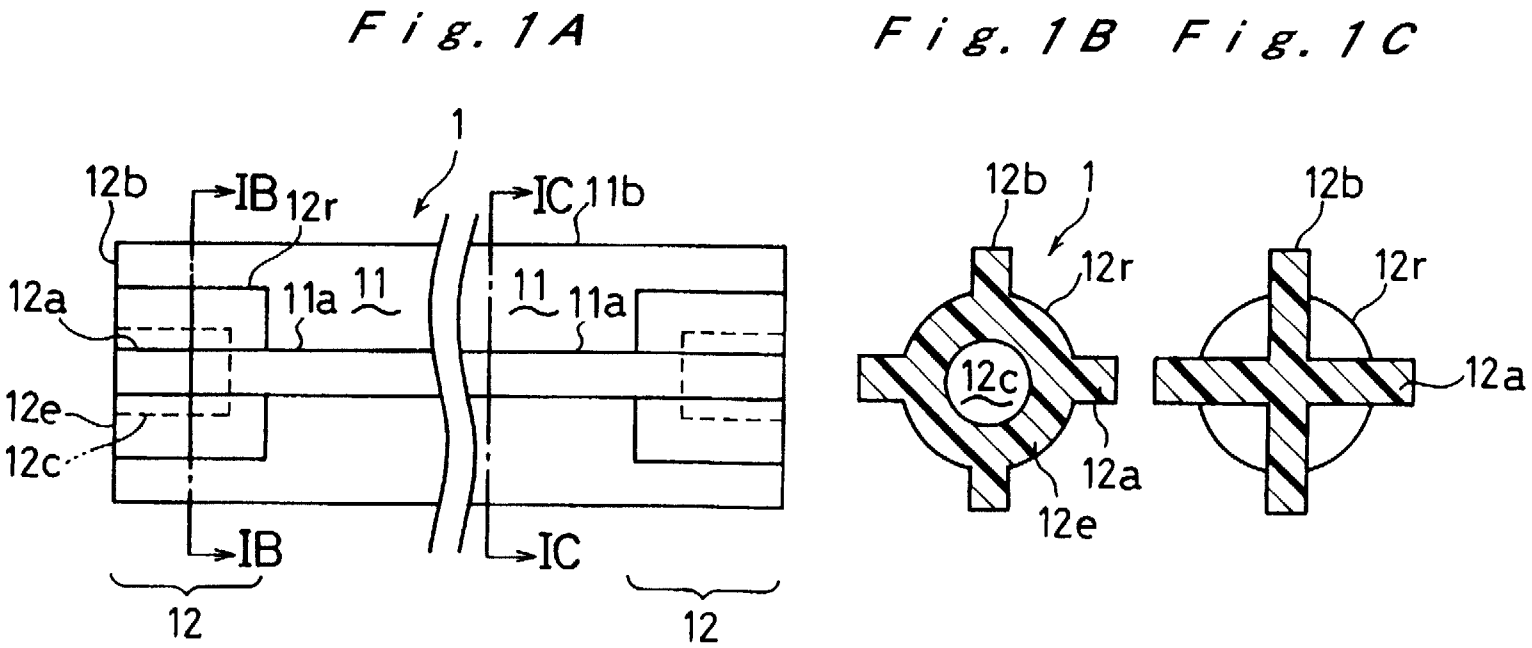
FIG. 1A is a schematic side view of a preferred embodiment of the spacer for a concrete form according to the present invention.
FIG. 1B is a sectional view taken in the direction of the arrows along the line IB—IB of FIG. 1A.
FIG. 1C is a sectional view taken in the direction of the arrows along the line IC—IC of FIG. 1A.

The continuous-length product according to the invention is formed from a fiber-reinforced resin and is characterized by a specific shape.

"Shape" of continuous-length products:

The fiber-reinforced resin continuous-length product of the invention includes combined thin members on its section vertical to the major axis (cross section). A continuous-length product which is thin but merely flat cannot meet the demands of various uses. Therefore, the present inventors have groped for a comprehensive concept of the sectional shape of the continuous-length product according to the invention, and the following concept has been attained.

That is, if the continuous-length products have a sectional shape satisfying the following condition, the product exhibits the tensile properties sought.

The value obtained by dividing the whole length (Lmm) of the sectional contour of the continuous-length product by the real area ($Smm^2$) of the section of the continuous-length product, L/S (unit: $mm^{-1}$), is in the range of 0.5 to 2.5 $mm^{-1}$, preferably 0.55 to 2.2 $mm^{-1}$.

The shape satisfying the above condition produces a wide surface on average having the restriction that the continuous-length products are relatively long and narrow. For example, there can be mentioned a tubular shape. Also employable is a flat plate-combined shape made up of plural continuous-length flat portions and combining portions each of which extends in the lengthwise direction of each flat portion and serves to combine one flat portion with at least one of the other flat portions, the flat portion meeting at an angle to other combined portion(s) on the section. Examples of sectional shapes of the continuous-length products having the above-mentioned shape include circular ring shape, polygonal ring shape (e.g., trigonal ring shape, tetragonal ring shape, rhombic ring shape), H shape, X shape (+ shape), * shape and ⧖ shape. The sectional shape of the continuous-length product of the invention is not limited to those examples, and modification to some degree is possible as long as the modified shapes satisfy the above-mentioned condition. For example, the "⧖ shape" may be varied into a shape of "I-I-I" (lateral lines and vertical lines are closely linked to each other). Further, the shape in which the center axis is enlarged in diameter in the X shape or the * shape, i.e., "shape of horned wheel" or "shape of spar gearwheel", is also included.

In addition to the restriction on the shape, the present invention is further restricted on the thickness (lower and upper limits) from a practical viewpoint. In the continuous-length products of the invention, the lower limit of the thickness is usually 1 mm, preferably 1.5 mm, and the upper limit is usually 4 mm, preferably 3.5 mm. This lower limit is a practical use limit in the case where the fiber reinforcement-containing resin is molded, and is determined because a product having a thickness smaller than the above-mentioned lower limit is rarely produced in the existing circumstances. If molding technique, molding material, molding apparatus, etc. are improved in the future, the lower limit might be revised.

Determination of the upper limit is based on the unexpected fact found in the studies by the present inventors. That is, the present inventors have groped for requisites to realize a tensile strength high enough to withstand large tension given to the continuous-length product when the product is used as a spacer for concrete form.

As a result of sufficient research on the relationship between the tensile strength and the thickness of the test specimen, existence of the upper limit of the spacer thickness was found from the data shown in Table 1. It is generally thought that the tensile strength becomes higher with an increase of the thickness. However, the data of Table 1 show an unexpected result that the highest tensile strength appears when the thickness is about 1 mm and then it gradually decreases as the thickness becomes larger.

However, it cannot be said that the tensile strength increases infinitely if the thickness is made smaller. In the fiber-reinforced resin continuous-length product, the fiber reinforcement tends to be arranged substantially parallel to the major axis of the continuous-length product mainly in the surface layer (portion), and this fiber orientation greatly contributes to the tensile strength of the continuous-length product. Accordingly, it is the most effective way to increase the tensile strength that the continuous-length products are made to have a shape, especially a shape of the cross section having the surface layer (portion) as large as possible.

The continuous-length product of the invention satisfying the above-defined conditions on the shape and the thickness is good for various uses wherein high tension is applied to the product. The continuous-length product of the invention may be modified in its structure according to its uses. The present invention is preferably used as a spacer (separator) for concrete form. The spacer of the invention comprises a long and narrow body and columnar portions positioned at the both side ends of the body, and is in the form of rod as a whole. On the columnar portions, bolt holes which open outward are provided. The spacer of the invention is formed from a fiber-reinforced resin, and in at least the surface layer (portion) of the spacer, the fiber reinforcement is arranged almost in parallel with the major axis of the spacer so as to reinforce the spacer. Hence, the spacer is thin and has high tensile strength.

Figure 4:
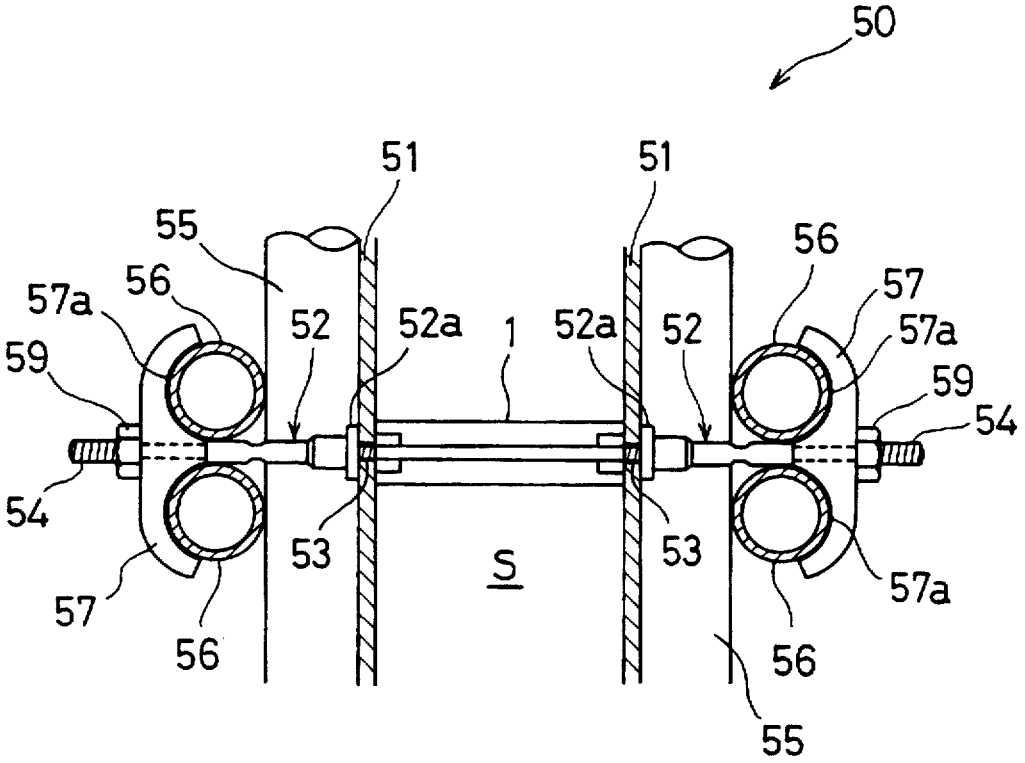
FIG. 4 is an enlarged sectional view of a main part of a concrete form built by the use of a spacer.

The form separator is now described in detail with reference to FIG. 4. FIG. 4 shows one example of a form using the form separator. As shown in FIG. 4, a form 50 includes form panels 51, 51 facing each other and a space S provided therebetween where concrete is placed. Each of the form panels 51, 51 is supported from the outside by a longitudinal pipe 55 that is perpendicularly arranged and a lateral pipe 56 that is horizontally arranged. The longitudinal pipe 55 and the lateral pipe 56 are fixed to the form panels 51, 51 by a clamping means made up of a separator 1, a form tie 52, a ribbed washer 57 and a nut 59.

This form separator 1 for constituting the clamping means is a continuous-length product and is arranged between the form panels 51, 51. In the form separator 1, into a bolt hole (not shown) formed on each end of the separator, a male screw 53 provided on one end of the form tie 52 is screwed from the outside of the form panel 51. The form tie 52 has a flange **52*a* positioned at the base of the external thread 53. The form panels 51, 51 are each interposed between the flange 52*a* and one end of the form separator 1, and they are fixed to both ends of the separator 1. Accordingly, the form panels 51, 51 form a space S having a given width, i.e., the same width as the length of the separator 1**.

The form tie 52 has a male screw 54 at the other end. This form tie penetrates the ribbed washer 57 arranged outside the form panel 51. The ribbed washer 57 has a pair of concave portions **57*a*, 57*a* each having such a shape as is complementary with the lateral pipe 56. When the external thread 53 and the nut 59 are tightened, the lateral pipe 56 and the longitudinal pipe 55 arranged inside the lateral pipe 56 are pressed inward by means of the ribbed washer 56, whereby they are fixed wish supporting the form panel 51**.

In the form 51 having such a structure as mentioned above, concrete is placed in the space S formed between the form panels 51, 51, the distance between the panels being kept by the separator 1.

The concrete is placed in the space of the form 50 as described above, and then cured and shaped. The concrete is not limited to Portland cement (commonly called "cement") or ordinary concrete (mixture containing, as its major components, cement, ballast and sand), and the concrete may include other building materials such as nonblended cement, plastic concrete (ordinary concrete added with special plastic as a strength improver), cement mortar (also referred to as "mortar", mixture of cement and sand) and cement plaster.

Next, the concrete form spacer of the invention favorably used for the above-described form will be described in detail with reference to FIGS. 1A to 1C.

FIG. 1A is a schematic side view of a preferred embodiment of the spacer according to the invention. A sectional view taken along the line IB—IB of FIG. 1A is shown in FIG. 1B. A sectional view taken along the line IC—IC of FIG. 1A is shown in FIG. 1C. As shown in these figures, the spacer 1 of this embodiment is a continuous-length product having a body 11 with a section in a nearly cross (X) shape. Each end zone 12 of the body includes a cylindrical portion **12*r*, a fin (blade or rib) 12*a* (perpendicular direction) and a fin 12*b* (horizontal direction) both radially protruding from the periphery of the cylindrical portion 12*r*. At the center of the cylindrical portion 12*r* or thereabout is provided a bolt hole 12*c* for receiving a fixing bolt (e.g., male screw of the form tie) which is to be inserted from the outside of the panel. That is, the cylindrical portion 12*c* is a cylinder constructed by a circumferential wall 12*e*, and each end surface of the spacer 1** is in the circular ring shape.

In this embodiment, the body 11 has a section in the shape of a cross. In FIG. 1C, the angle formed by the horizontal arm **11*a* and the perpendicular arm 11*b* both of which produce the cross shape is 90 degrees. However, in the present invention, the angle formed by the arms 11*a* and 11*b* of the body having a section in the shape of a cross does not need to be 90 degrees. For example, the angle formed by the arms 11*a* and 11*b* of the body may be any value, for example, 60 degrees, as long as the value satisfies the purpose for which the spacer is applied. The spacer 1 of this embodiment is designed to have arms 11*a* and 11*b*** meeting at right angles so that the spacer can evenly withstand external forces applied from various directions.

In FIG. 1A, the perpendicular fin **12*b* extending outward from the periphery of the cylindrical portion 12*r* is a part of the arm 11*a* for forming the body 11, and the horizontal fin 12*b* is 11*a* part of the arm 11*b* for forming the body 11. The diameter of the bolt hole 12*c* occupies a relatively large portion of the diameter of the cylindrical member 12*r*, and therefore each side end 12*e*** appears to be in the ring shape.

In this embodiment, the shapes of the portions present on both sides of the central double curves in FIG. 1A are the same as each other, but they may be different from each other in some embodiments of the invention.

One preferred embodiment of the invention is illustrated above with reference to FIGS. 1A to 1C, but the spacer of the invention is not limited to this embodiment. For example, the sectional shape of the spacer 1 of the invention is not limited to the cross shape, and other shapes such as a shape having plurality of arms is also available. Further, the sectional shape may be tubular (ring) shape, circular ring shape, trigonal ring shape, tetragonal ring shape or hexagonal ring shape. The arms **11*a*, 11*b* may be provided with vent holes almost vertically penetrating the arms 11*a*, 11*b* which constitute the body 11**, so as to inhibit residence of air between the arms when the concrete is placed between form panels.

Another embodiment of the spacer according to the invention is described below in detail with reference to FIGS. 2A to 2C.

FIG. 2A is a schematic side view of another embodiment of the spacer according to the invention. FIG. 2B is a sectional view taken along the line IIB—IIB of FIG. 2A. FIG. 2C is a sectional view taken along the line IIC—IIC of FIG. 2A.

As shown in these figures, the spacer 2 of this embodiment has a section approximately an I shape or a sideways H shape. Each side end zone 22 includes a cylindrical portion **22*r* with a side end 22*e*, a top plate 22*a* and a bottom plate 22*b*, the top and bottom plates interposing the cylindrical portion 22*r*** therebetween.

As shown particularly in FIG. 2B, the top plate **22*a* and the cylindrical portion 22*r* meet each other to form a U-shaped gentle curve, and also the bottom plate 22*b* and the cylindrical member 22*r* meet each other to form a U-shaped gentle curve. In this figure, a bolt hole 22c positioned at the center is a depression for receiving a fixing bolt (e.g., form tie) to be inserted thereinto from the outside of the panel, similar to 12c in FIG. 1. The side end 22e appears to be in a circular ring shape because the diameter of the depression occupies a relatively large portion of the diameter of the cylindrical member 22r**.

As shown in FIG. 2C, a back surface of the cylindrical member 22r appears on the backside of the body 21 having an I-shaped or sideways H-shaped section. As is apparent from this figure, the top plate 22a is connected with the cylindrical member 22r to form a U-shaped gentle line, and also the bottom plate 22b is connected with the cylindrical member 22r to form a U-shaped gentle line.

In FIG. 2A, the shapes of the members present on both sides of the double curves shown in the center are the same as each other, but they may be different from each other.

The body 21 may be provided with a vent hole almost vertically penetrating the body 21 to inhibit residence of air when the concrete is placed between the form panels.

Two preferred embodiments of the spacer according to the invention are illustrated above with reference to FIGS. 1A to 1C and FIGS. 2A to 2C. The whole length of the spacer 1 or 2 is almost equal to the distance between the form panels to which the spacer is fitted, and therefore the absolute value for the whole length is determined based on the width of the form. In general, the length of the spacer is selected from values established based on the Japanese traditional dimensional system, i.e., 150 mm (5 sun) and multiples of 150 mm, e.g., 300 mm (1 shaku) and 450 mm (1 shaku 5 sun).

The sectional size of the spacer 1 or 2 of the above embodiment is also selected from values established based on the Japanese traditional dimensional system. For example, when the section is in the shape of circle, its diameter (including inner diameter and outer diameter) is selected from about 15 mm (5 bu), 18 mm (6 bu), 21 mm (7 bu), 24 mm (8 bu), 27 mm (9 bu) and 30 mm (1 sun). When the section is in the shape of square or rectangle, its longitudinal length and lateral length (length of diagonal line in some cases) are also selected from those values.

The side end zone 12 or 22 of the spacer 1 or 2 of the above embodiment generally is cylindrical. The bolt hole 12c or 22c formed in the vicinity of the center of the end 12e or 22e of the side end zone is provided with a female screw. This bolt hole 12c or 22c serves to receive and fix the male screw of the clamping bolt (e.g., male screw of form tie) which is inserted from the outside by way of a through hole of the form. The side end 12e of the cylindrical member 12r or 22r is designed to be in contact with the inner surface of the form wall and to have an area large enough to withstand the clamping pressure applied from the outside of the form.

Material of continuous-length product:

In the continuous-length product of the invention in the above-mentioned shape, particularly a spacer, a fiber reinforcement, usually made of hard glass fibers, is uniformly dispersed and contained in the resin matrix in such a manner that the fiber reinforcement is arranged substantially parallel to the major axis of the spacer in at least the surface portion (layer) of the spacer.

The resin for forming the matrix may be either a thermoplastic resin or a thermosetting resin. Examples of the thermoplastic resins include crystalline polyolefin resins, modified products of such resins, e.g., maleic anhydride-grafted resins containing maleic anhydride (modifier) in an amount of usually 0.01 to 1% by weight, preferably 0.05 to 0.5% by weight, polyamide resin (nylon), acrylic resin, polycarbonate resin, polyvinyl chloride resin, polysulfone resin, polyurethane resin, polystyrene resin and ABS resin. These resins may be used singly or in combination of two or more kinds. Above all, a polymer alloy resin composition of a crystalline polypropylene resin (typical crystalline polyolefin resin) with a polyamide resin can be mentioned as one example of a preferred combination.

In the preparation of polymer alloys, a graft modified adhesive polypropylene resin or an adhesive ethylenepropylene elastomer is preferably added as a polymer mediator to the affinity between the polypropylene resin and the polyamide resin or between the polypropylene resin and the fiber reinforcement, whereby a practically useful resin composition for matrix can be obtained. This is important also in the case of a nonblended polypropylene resin.

The polypropylene resin used as a matrix singly or in combination with other resins is a crystalline propylene homopolymer or a crystalline propylene-α-olefin copolymer (particularly a crystalline propylene-ethylene copolymer, a crystalline propylene-1-butene copolymer or a crystalline propylene-ethylene-1-butene copolymer) each having MFR (230° C., 2.16 kgf) of not less than 10 g/10 min, preferably 30 to 100 g/10 min, and a melting point (Tm) of 160° to 170° C., preferably 163° to 168° C. These polymers are used singly or in combination of two or more kinds according to necessity.

Examples of the polyamide resins include ring-opening addition polymerization nylons such as 6-nylon, 7-nylon, 11-nylon and 12-nylon, copolycondensation nylons such as 6,6-nylon, 6,7-nylon, 6,10-nylon and 6,12-nylon, and xylylenediamine-lower aliphatic dicarboxylic acid copolycondensation nylons.

When the resin matrix in the reinforced composition for forming the continuous-length products of the invention, particularly a spacer for concrete form, is a polymer alloy, the polymer alloy is prepared by blending the polyamide resin (nylon) and the crystalline polyolefin in a weight ratio of usually 75/25 to 50/50, preferably 71/29 to 53/47 (polyamide resin/crystalline polyolefin) and kneading them while heating. The polymer alloy has the following crystallization equilibrium time.

Figure 3:
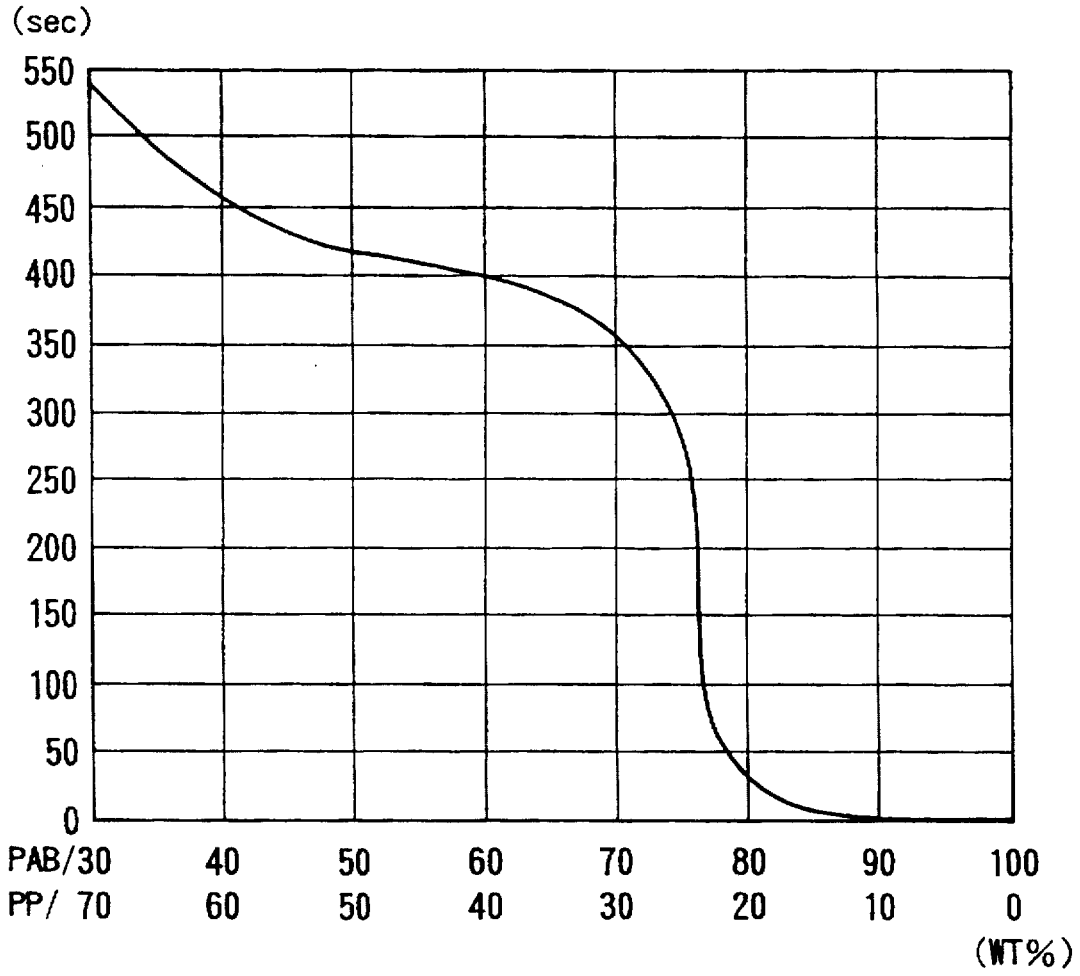
FIG. 3 is a correlation diagram showing a relationship between the component ratio of a polymer alloy resin composition for matrix useful for the fiber-reinforced resin for forming the continuous-length products (e.g., spacer) of the invention and the crystallization equilibrium time of the composition.

FIG. 3 shows a relationship between the composition of the polymer alloy for matrix and the crystallization equilibrium time. As shown in FIG. 3, owing to the above-defined blending ratio, a resin composition having a crystallization equilibrium time (time required for attainment of a crystallinity of 100%) of 300 to 550 sec, preferably 350 to 420 sec, can be obtained as a resin matrix. According to circumstances, however, the conditions for setting the crystallization equilibrium time within the above range needs to have priority to the resin blending ratio.

The fiber reinforcement used together with the matrix is at least one of an inorganic fiber, an organic fiber and a carbon fiber. These fibers may be used in combination of two or more kinds, if desired. Although the carbon fiber may be included with the inorganic fiber or the organic fiber, it is classified herein as a third fiber not belonging to any of those fibers.

Examples of the reinforcing inorganic fibers include glass fibers (glass wool), metallic fibers and rock fibers (rock wool). The most widely used as the practical one among the inorganic fibers is a hard glass (commonly called "E glass") fiber, and this hard glass fiber is also advantageous in cost. However, in uses where a large absolute value of the weight is regarded as disadvantageous, the hard glass fiber is hardly considered to be the most predominant reinforcing fiber. That is, it is inferior in specific strength.

Because of their lightweight properties and high strength, all aromatic polyester resin fibers and all aromatic polyamide resin fibers have been already put into practical use as the reinforcing organic fibers. These resin fibers are commercially available, and one example of the former is "Kevler" (trade name), and one example of the latter is "Chelimide" (trade name).

The reinforcing carbon fibers prepared by various processes are on the market, and one example thereof is "Thorenl-40" (trade name, available from Union Carbide Co.). The carbon fiber is advantageous in its extremely high specific strength (strength/gravity) of 90 kgf/mm$^2$·g. The carbon fiber is estimated as best in the specific strength because of its small absolute value of the weight. Moreover, the carbon fiber has moderate electrical conductivity. On the other hand, the metallic fiber shows high electrical conductivity, and additionally it has high flexibility (recovery of deformation) in the wide range and high elastic modulus.

Examples of metals for forming the metallic fibers include iron, iron alloys, particularly steel such as ordinary steel and special steel (e.g., high tensile strength steel, stainless steel), copper, and copper alloys such as brass (gun metal, alloy of copper and zinc), bronze (alloy of copper and tin), manganese bronze and phosphor bronze.

Hereinafter a case in which the glass fiber is used as the fiber reinforcement will be described in more detail. The glass fiber reinforcement is provided generally in the form of a fiber bundle such as a roving or end. The number of fibers bundled is usually in the range of 500 to 4,000, and the mean diameter of the unit filaments is in the range of 3 to 21 μm. The surface of the glass fiber reinforcement is preferably subjected to a treatment to improve affinity for the matrix polymer, such as an aminosilane treatment, a carboxysilane treatment or a treatment with a silane compound containing both an amino group and a carboxyl group.

The glass fiber reinforcement has a mean fiber length of usually 0.3 mm (short fiber) to 30 mm (long fiber), preferably 3 to 30 mm, more preferably 5 to 25 mm. The tensile strength of the glass fiber reinforcement is not less than 20.5 MPa, and the tensile modulus thereof is not less than 725 MPa.

In the reinforced composition for forming the continuous-length products of the invention, the resin composition for the matrix is contained in an amount of 90 to 60% by weight, preferably 80 to 70% by weight, and the glass fiber reinforcement is contained in an amount of 10 to 40% by weight, preferably 20 to 30% by weight, (total amounts of both component: 100% by weight). It is important that the glass fiber reinforcement is dispersed in the matrix and the reinforcement fibers are arranged substantially parallel to each other.

When a lightweight fiber reinforcement such as carbon fiber is used, the blending ratio thereof to the matrix is in the range of 14/86 to 46/54 (carbon fiber/matrix, by weight), and the amount of the fiber reinforcement is smaller than in the case of other fibers. However, even if the carbon fiber is used in a small amount, the amount is enough to exhibit necessary strength. Therefore, it should be considered that the carbon fiber has higher strength (higher specific strength) for its light weight.

When the matrix resin composition of the invention contains crystalline polyolefin, crystalline polyolefin modified with maleic anhydride or the like is added, based on the crystalline polyolefin of 70 to 90% by weight, preferably 75 to 85% by weight, in an amount of 30 to 10% by weight, preferably 25 to 15% by weight. The modified crystalline polyolefin serves not only to improve the adhesion between the fiber reinforcement and the crystalline polyolefin, that is one component of the resin matrix, but also to improve adhesion between the crystalline polyolefin and the polar group-containing resin, that is the other component of the resin matrix.

FIG. 3 shows a relationship between the tendency of the crystallization equilibrium (plotted as ordinate) of a polymer alloy used as the matrix resin for forming the continuous-length products of the invention and the composition of the matrix (plotted as abscissa). In this example, an abrupt change is observed when the ratio of the polyamide to the modified polyolefin is in the range of 70/30 to 80/20, and accordingly it can be considered that a polymer alloy is produced.

Process for preparing continuous-length products:

As described above, the continuous-length product according to the invention is a kind of composite in which the fiber reinforcement is contained in the matrix comprising a thermoplastic or thermosetting resin (preferably thermoplastic resin) in such a manner that the loosened (opened) fibers of the reinforcement are impregnated with the resin. Although there are several processes to mold the composite into the continuous-length product, preferably adopted is a process capable of producing a continuous-length product wherein the fiber reinforcement is arranged in a given direction, generally almost the same direction as the major axis of the product, in at least the surface portion (layer) of the product.

For producing the continuous-length products of the invention, an injection molding process is particularly preferred. The reason why the injection molding process is preferred as a means to mold a resin composition containing a fiber reinforcement or pellets (primary molded product) thereof into a continuous-length product as a final molded article is that the fiber reinforcement is contained in the resulting continuous-length product in such a manner that the reinforcement is arranged in a given direction, generally almost the same direction as the major axis of the product, in at least the surface portion of the product. In other molding processes (e.g., T-die extrusion molding process), however, such an arranged state as mentioned above is hardly attained, and it is difficult to form a product having a cross section of complicated shape, particularly a product having a ring-shaped section.

In the continuous-length products of the invention, it is particularly preferred that the fiber reinforcement be arranged substantially parallel to (the same direction as) the major axis of the product in at least the surface portion of the product. The most effective molding process to impart the above-mentioned arranged state to the product is the "injection molding process". Accordingly, it is very desirable to adopt this "injection molding process" in order to prepare the continuous-length product of the invention. Further, a gate for introducing a molding material into the mold is desirably provided at the end of the mold or in the vicinity thereof along the prolonged line of the major axis of the mold. This is different from the conventional injection molding process to produce a continuous-length product. In the conventional injection molding process, the gate is generally provided in the vicinity of the center of the mold. If the gate is provided at the end of the major axis of the mold, the resin is cooled while it flows from the gate to the other end, whereby the resin barely flows. In order to avoid such state, the gate is generally provided in the vicinity of the center of the mold.

The present invention will be further described with reference to the following examples, but it should be construed that the invention is in no way limited to those examples.

The conditions and standards used for measuring the properties in the following examples are as follows.

(1) Melt flow rate:

The melt flow rate (g/10 min) is measured under the test condition 14 (230° C., 2.16 kgf) of JIS K7210 (1976).

(2) Crystalline melting point (Tm):

A test specimen of 10 mg is heated at a rate of 20° C./min from room temperature (23° C.) in a nitrogen atmosphere to measure an endothermic curve given by fusion of crystal by means of a differential scanning calorimeter (DSC). The temperature (°C.) at the peak of the endothermic curve is taken as the crystalline melting point. When plural peaks are observed, a peak having the largest area is used to determine the crystalline melting point.

(3) Tensile strength:

The tensile strength (kgf/mm$^2$) is measured in accordance with JIS K7113.

(4) Tensile modulus:

The tensile modulus (kgf/mm$^2$) is measured in accordance with JIS K7203.

EXAMPLES 1–3

COMPARATIVE EXAMPLE 1

To an extruder, a matrix resin of crystalline polyolefin comprising a crystalline modified propylene homopolymer resin (maleic anhydride unit content: 0.3% by weight, MFR (230° C., 2.16 kgf): 30 g/10 min, crystalline melting point (Tm): 163° C.) and a crystalline unmodified propylene homopolymer resin (MFR (230° C., 2.16 kgf): 30 g/10 min, crystalline melting point (Tm): 163° C.) was fed at a prescribed feed rate through the resin feed opening, and a hard glass roving (mean fiber diameter: 17 μm, number of filaments: 4,000, available from Nippon Electric Glass Co., Ltd.) was fed at a prescribed feed rate through the roving feed opening, to obtain glass fiber-reinforced strands. The strands were cut into prescribed lengths to obtain glass long fiber-reinforced resin pellets containing 60% by weight of the matrix resin and 40% by weight of the glass long fiber reinforcement.

The pellets were fed to an injection molding machine (screw diameter: 40 mm, screw compression ratio: 1.7, L/D=16.9) and melted. The resulting molten composition (250° C.) was then fed to a mold equipped at the tip of the injection molding machine to prepare a continuous-length specimen having a sectional shaoe shown in Table 1. The results obtained by the physical property tests are set forth in Table 1.

As Comparative Example 1, a continuous-length specimen having a sectional shape shown in Table 1 was prepared using the same glass long fiber-reinforced resin pellets as in Example 1. The mean thickness of this specimen was varied to 6 mm, which was out of the scope of the invention. The results obtained by the physical property tests are set forth in Table 1.

EXAMPLES 4–6,

COMPARATIVE EXAMPLE 2

To an extruder having two feed openings, one of which (first feed opening) is located in the vicinity of the upstream end of the barrel and the other of which (second feed opening) is located on the downstream side of the first feed opening, 70% by weight (based on the reinforced composition) of a matrix resin of the same crystalline polyolefin as in Examples 1 to 3 was fed through the first feed opening, and 30% by weight (based on the reinforced composition) of a hard glass short fiber reinforcement (mean fiber length: 0.5 mm) was fed through the second feed opening, followed by melt kneading to obtain glass short fiber-reinforced pellets. The pellets were subjected to the same operation as in Examples 1 to 3 by the use of the same injection molding machine as in Examples 1 to 3, to prepare a continuous-length specimen having a sectional shape shown in Table 1. The results obtained by the physical property tests are set forth in Table 1.

As Comparative Example 2, a continuous-length specimen having a sectional shape shown in Table 1 was prepared using the same glass short fiber-reinforced resin pellets as in Examples 4 to 6. The mean thickness of this specimen was varied to 6 mm, which was out of the scope of the invention. The results obtained by the physical property tests are set forth in Table 1.

EXAMPLES 7 and 8

COMPARATIVE EXAMPLE 3

A matrix resin of the same crystalline polyolefin as used in Examples 1 to 3 was fed to the extruder in a prescribed amount through the resin feed opening and melt kneaded, while the same glass roving as in Examples 1 to 3 was fed to the extruder in a prescribed amount through the roving feed opening, to obtain glass fiber-reinforced strands. The strands were cut into prescribed lengths to obtain glass long fiber-reinforced resin pellets containing 60% by weight of the matrix resin and 40% by weight of the glass long fiber reinforcement.

The pellets were subjected to the same operation as in Examples 1 to 3 by the use of the same injection molding machine as in Examples 1 to 3, to prepare a continuous-length specimen having a sectional shape shown in Table 1. The results obtained by the physical property tests are set forth in Table 1.

As Comparative Example 3, a continuous-length specimen having a sectional shape shown in Table 1 was prepared using the same glass short fiber-reinforced resin pellets as in Examples 1 to 3. The mean thickness of this specimen was varied to 6 mm, which was out of the scope of the invention. The results obtained by the physical property tests are set forth in Table 1.

EXAMPLE 9

A matrix resin of the same crystalline polyolefin as in Examples 1 to 3 and the same glass roving as in Examples 1 to 3 were subjected to the same operation as in Examples 1 to 3 by the use of the same extruder as in Examples 1 to 3, to obtain long fiber-reinforced resin pellets containing 80% by weight of the matrix resin of the crystalline polyolefin and 20% by weight of the glass long fiber reinforcement. The pellets were subjected to the same operation as in Examples 1 to 3 by the use of the same injection molding machine as in Examples 1 to 3, to prepare a continuos-length specimen having a sectional shape shown in Table 1. The results obtained by the physical property tests are set forth in Table 1.

EXAMPLES 10 and 11

COMPARATIVE EXAMPLES 4 and 5

6,6-Nylon (trade designation: CM3001N, available from Toray Industries, Inc.) (Example 10) or a polyamide-6 resin (trade designation: CM1017, available from Toray Industries, Inc.) (Example 11) as a polyamide resin for resin matrix, a crystalline modified propylene homopolymer resin (maleic anhydride unit content: 0.3; by weight, MFR (230° C., 2.16 kgf): 30 g/10 min, crystalline melting point (Tm): 163° C.) and a crystalline unmodified homopolypropylene (MFR (230° C., 2.16 kgf): 30 g/10 min crystalline melting point (Tm): 163° C.) were blended in a blending ratio shown in Table 1. The resulting blend was fed to an extruder through the resin feed opening and melt kneaded to prepare a polymer alloy. The polymer alloy and the short fiber reinforcement were subjected to the same operation as in Examples 4 to 6 by the use of the same extruder (equipped with two feed openings) as in Examples 4 to 6, to prepare a fiber-reinforced specimen (having a sectional shape shown in Table 1) containing the polymer alloy as a resin matrix, which contains the polymer alloy resin matrix and the short fiber reinforcement in the ratio shown in Table 1. To the extruder was fed a glass roving (mean fiber diameter: 17 μm, number of filaments: 4,000, available from Nippon Electric Glass Co.) in a prescribed amount through the roving feed opening to obtain glass fiber-reinforced strands. The strands were cut into prescribed lengths to obtain glass long fiber-reinforced resin pellets in which a polymer alloy was used as the resin matrix.

The pellets were fed to an injection molding machine (screw diameter: 40 mm, screw compression ratio: 1.7, L/D: 16.9) and melted. The resulting molten composition (250° C.) was then fed to a mold equipped at the tip of the injection molding machine to prepare a continuous-length specimen having a sectional shape shown in Table 1. The results obtained by the physical property tests are set forth in Table 1. In Table 1, the term "thickness" means a thickness of the molded article, not a thickness of a sliced portion of the molded article. In other words, the thickness is a width of a ring-shaped portion defined by the outer periphery and the inner periphery of the section of the hollow molded article.

In Comparative Examples 5 and 6, the thickness of the specimen was outside of the scope of the invention. A reinforced composition in which an ordinary short fiber reinforcement (mean fiber length: 0.5 mm) was contained in the resin matrix in the same amount as in the invention examples was used. The results obtained by the physical property tests are set forth in Table 1.

TABLE 1

| Experiment No. | Composition of continuous-length products Material: Matrix resin PO Kind | PO Amount | PA Kind | PA Amount | Amount wt % | Fiber reinforcement Length mm | Amount wt % |
|---|---|---|---|---|---|---|---|
| Ex. 1 | PP | 60 | — | — | 60 | long | 40 |
| Ex. 2 | PP | 60 | — | — | 60 | long | 40 |
| Ex. 3 | PP | 60 | — | — | 60 | long | 40 |
| Comp. Ex. 1 | PP | 60 | — | — | 60 | long | 40 |
| Ex. 4 | PP | 70 | — | — | 70 | short | 30 |
| Ex. 5 | PP | 70 | — | — | 70 | short | 30 |
| Ex. 6 | PP | 70 | — | — | 70 | short | 30 |
| Comp. Ex. 2 | PP | 70 | — | — | 70 | short | 30 |
| Ex. 7 | PP | 60 | — | — | 60 | long | 40 |
| Ex. 8 | PP | 60 | — | — | 60 | long | 40 |
| Comp. Ex. 3 | PP | 60 | — | — | 60 | long | 40 |
| Ex. 9 | PP | 80 | — | — | 80 | long | 20 |
| Ex. 10 | — | — | PA66 | 70 | 70 | short | 30 |
| Ex. 11 | PP | 30 | PA6 | 70 | 65 | short | 35 |
| Comp. Ex. 4 | PP | 30 | PA6 | 70 | 70 | short | 30 |
| Comp. Ex. 5 | PP | 30 | PA6 | 70 | 65 | short | 35 |

PA: polyamide-6 (nylon-6) not otherwise indicated,
PA66: polyamide-66 (nylon-66),
The modified crystalline polyolefin resin contains 0.3% by weight of maleic anhydride units.

| Experiment No. | Shape of continuous-length products: Dimensional factors: Sectional shape | Size: Height mm | × | Width mm | × | Thickness mm | Requisite: Real sectional area mm² | Outer periphery/real sectional area mm/mm² |
|---|---|---|---|---|---|---|---|---|
| Ex. 1 | — | 10 | | | | 1 | 10 | 2.20 |
| Ex. 2 | — | 10 | | | | 3 | 30 | 0.87 |
| Ex. 3 | — | 10 | | | | 4 | 40 | 0.70 |
| Comp. Ex. 1 | — | 13 | | | | 6 | 78 | 0.49 |
| Ex. 4 | — | 10 | | | | 1 | 10 | 2.20 |
| Ex. 5 | — | 10 | | | | 3 | 30 | 0.87 |
| Ex. 6 | — | 10 | | | | 4 | 40 | 0.70 |
| Comp. Ex. 2 | — | 13 | | | | 6 | 78 | 0.49 |
| Ex. 7 | X | 15 | | 15 | | 3 | 81 | 0.74 |
| Ex. 8 | X | 20 | | 20 | | 4 | 144 | 0.56 |
| Comp. Ex. 3 | X | 30 | | 30 | | 6 | 324 | 0.37 |
| Ex. 9 | — | 10 | | | | 3 | 30 | 2.20 |
| Ex. 10 | — | 10 | | | | 3 | 30 | 2.20 |
| Ex. 11 | — | 10 | | | | 3 | 30 | 2.20 |
| Comp. Ex. 4 | — | 13 | | | | 6 | 78 | 0.49 |
| Comp. Ex. 5 | — | 13 | | | | 6 | 78 | 0.49 |

PA: polyamide-6 (nylon-6) not otherwise indicated,
PA66: polyamide-66 (nylon-66),
The modified crystalline polyolefin resin contains 0.3% by weight of maleic anhydride units.

| Experiment No. | Properties of continuous-length products: Tensile strength (at break) MPa | Tensile elongation (at break) % | State of fiber arrangement |
|---|---|---|---|
| Ex. 1 | 177 | 10.2 | excellent |
| Ex. 2 | 173 | 9.0 | good |
| Ex. 3 | 150 | 8.3 | good |
| Comp. Ex. 1 | 96 | 7.5 | a little bad |
| Ex. 4 | 132 | 9.5 | excellent |
| Ex. 5 | 118 | 8.4 | good |
| Ex. 6 | 106 | 7.1 | good |
| Comp. Ex. 2 | 71 | 6.5 | a little bad |
| Ex. 7 | 178 | 9.2 | good |
| Ex. 8 | 157 | 8.7 | good |
| Comp. Ex. 3 | 98 | 7.5 | a little bad |
| Ex. 9 | 122 | 8.2 | excellent |
| Ex. 10 | 133 | 8.2 | excellent |
| Ex. 11 | 142 | 8.4 | good |
| Comp. Ex. 4 | 94 | 7.0 | a little bad |
| Comp. Ex. 5 | 76 | 6.5 | a little bad |

PA: polyamide-6 (nylon-6) not otherwise indicated,
PA66: polyamide-66 (nylon-66),
The modified crystalline polyolefin resin contains 0.3% by weight of maleic anhydride units.

EFFECT OF THE INVENTION

As described above, the continuous-length products of the invention are formed from a fiber-reinforced resin and are designed to have a shape ratio |whole length of the outer periphery of the section (Lmm)/real area of the section ($Smm^2$)| of 0.5 to 2.5/mm and a thickness of 1 to 4 mm. Hence, the continuous-length products are excellent in the tensile strength.

The spacer of the invention is the above-mentioned continuous-length product having bolt holes on both side ends. The spacer is formed from a fiber-reinforced resin comprising a resin matrix and a fiber reinforcement, and in the spacer the fiber reinforcement is dispersed and contained in the resin matrix in such a manner that the fiber reinforcement is arranged substantially parallel to the major axis of the spacer in at least the surface portion of the spacer. Hence, the spacer is excellent in tensile strength and is able to sufficiently withstand the outward high tensile stress given by concrete placed in the concrete form. Moreover, the weight of the spacer and the amount of the material used for preparing the spacer can be made as small as possible.

In the process for preparing a continuous-length product according to the invention, a molten fiber-reinforced resin formed from 85 to 50% by weight of a matrix resin and 15 to 50% by weight of a fiber reinforcement having a mean fiber length of 0.3 to 30 mm (total amount: 100% by weight) is introduced into a continuous-length mold in such a manner that the molten fiber-reinforced resin is substantially parallel to the major axis of the mold. Hence, there can be produced a continuous-length product wherein the fiber reinforcement is dispersed and contained in the resin matrix in such a manner that the fiber reinforcement is arranged substantially parallel to the major axis of the product in at least the surface layer of the product. The continuous-length products thus obtained is excellent in lightweight properties and tensile strength.

What is claimed is:

1. A product in a continuous length comprising a columnar or tubular body, said body including a fiber-reinforced resin comprising a fiber reinforcement having a mean fiber length of 0.3 to 30 mm and a resin matrix, said body having a shape ratio of 0.5 to 2.5/mm and a thickness of 1 to 4 mm, the shape ratio is defined as a ratio of a distance around the periphery of a cross-section of said product to a cross-sectional area of said cross-section, and said fiber reinforcement is arranged substantially parallel with a major axis of the body in at least a surface layer of the body.

2. The product in a continuous length as claimed in claim 1 wherein the shape of the cross-section of said product is selected from the group consisting of an X shape, + shape, H shape, ⊠ shape, * shape, a circular ring shape and a polygonal ring shape.

3. The product in a continuous length as claimed in claim 1 wherein the thickness of the body is from 1.5 to 3.5 mm.

4. The product in a continuous length as claimed in claim 1 wherein the mean fiber length of the fiber reinforcement is from 3 to 30 mm and the thickness of the body is from 1.5 to 3.5 mm.

5. The product in a continuous length as claimed in claim 1 wherein the fiber reinforcement is 15 to 50% by weight of the body.

6. The product in a continuous length as claimed in claim 1 wherein the fiber reinforcement is 20 to 40% by weight of the body.

7. The product in a continuous length as claimed in claim 1 wherein the fiber reinforcement includes at least one fiber selected from the group consisting of inorganic fibers and organic fibers.

8. The product in a continuous length as claimed in claim 1 wherein the fiber reinforcement comprises a hard glass fiber having a mean fiber diameter of 3 to 21 μm, a tensile strength of not less than 20.5 MPa and a tensile modulus of 725 MPa.

9. The product in a continuous length as claimed in claim 1 wherein the resin matrix comprises at least one resin selected from the group consisting of thermoplastic resins and thermosetting resins.

10. The product in a continuous length as claimed in claim 1 wherein the resin matrix comprises a crystalline thermoplastic resin.

11. The product in a continuous length as claimed in claim 1 wherein the resin matrix comprises a thermoplastic resin selected from the group consisting of a crystalline polyolefin resin, a polyamide resin, and combinations thereof.

12. The product in a continuous length as claimed in claim 1 wherein the resin matrix comprises a material selected from the group consisting of a crystalline polyolefin resin, a thermoplastic resin, and mixtures thereof, and wherein said crystalline polyolefin resin includes a polyolefin resin at least partially modified with maleic anhydride and present in an amount of 10 to 30% by weight of the resin matrix.

13. The product in a continuous length as claimed in claim 11 wherein the crystalline polyolefin resin is at least one polymer selected from the group consisting of a crystalline propylene homopolymer and a crystalline propylene-α-olefin copolymer, said crystalline polyolefin resin having a MFR (230° C., 2.16 kgf) of not less than 10 g/10 min and a crystalline melting point (Tm) of 160° to 170° C.

14. The product in a continuous length as claimed in claim 13, wherein the α-olefin in the crystalline propylene-α-olefin copolymer includes ethylene.

15. The product in a continuous length as claimed in claim 11 wherein the polyamide resin comprises at least one nylon selected from the group consisting of 6-nylon, 7-nylon, 11-nylon, 12-nylon, 6,6-nylon, 6,7-nylon, 6,10-nylon, 6,12-nylon, and xylylenediamine-lower aliphatic dicarboxylic acid copolycondensation nylon.

16. The product in a continuous length as claimed in claim 1 wherein the resin matrix comprises a resin composition having 50 to 75% by weight of a polyamide resin and 25 to 50% by weight of a crystalline polyolefin resin based on the weight of the resin composition, and having a crystallization equilibrium time of 300 to 550 seconds.

17. The product in a continuous length as claimed in claim 1 wherein the resin matrix includes a resin composition comprising 53 to 71% by weight of a polyamide resin and 29 to 47% by weight of a crystalline polyolefin resin based on the weight of the resin composition, and having a crystallization equilibrium time of 350 to 420 seconds.

18. The product in a continuous length as claimed in claim 1, wherein the shape ratio is in the range from 0.55 to 2.2/mm.

19. An injection molding process for forming a product in a continuous length, comprising introducing a molten fiber-reinforced resin containing 50 to 85% by weight of a matrix resin and 15 to 50% by weight of a fiber reinforcement having a mean fiber length of 0.3 to 30 mm based on the weight of the fiber-reinforced resin, into a continuous-length mold in such a manner that the molten fiber-reinforced resin is fed almost along a major axis of the mold.

20. The injection molding process for forming a product in a continuous length as claimed in claim 19, wherein the mean fiber length of the fiber reinforcement is 3 to 30 mm.

21. A resin spacer for use with concrete forms comprising a columnar or tubular body, said spacer having bolt holes on opposite ends of the body, said body including a fiber-reinforced resin comprising a fiber reinforcement having a mean fiber length of 0.3 to 30 mm and a resin matrix, said body having a shape ratio of 0.5 to 2.5/mm and a thickness of 1 to 4 mm, the shape ratio is a ratio of a distance around the periphery of a cross-section of said product to a cross-sectional area of said cross-section, and said fiber reinforcement is arranged substantially parallel with a major axis of the body in at least a surface layer of the body.

22. The spacer as claimed in claim 21 wherein the thickness of the body is from 1.5 to 3.5 mm.

23. The spacer as claimed in claim 21 wherein the mean fiber length of the fiber reinforcement is 3 to 30 mm and the thickness of the body is 1.5 to 3.5 mm.

24. The spacer as claimed in claim 21 wherein the fiber reinforcement is in an amount of 15 to 50% by weight.

25. The spacer as claimed in claim 21 wherein the fiber reinforcement is 20 to 40% by weight of the spacer.

26. The spacer as claimed in claim 21 wherein the fiber reinforcement includes at least one fiber selected from the group consisting of inorganic fibers and organic fibers.

27. The spacer as claimed in claim 21 wherein the fiber reinforcement comprises a hard glass fiber having a mean fiber diameter of 3 to 21 μm, a tensile strength of not less than 20.5 MPa, and a tensile modulus of not less than 725 MPa.

28. The spacer as claimed in claim 21 wherein the resin matrix includes a resin composition comprising 50 to 75% by weight of a polyamide resin and 25 to 50% by weight of a crystalline polyolefin resin based on the weight of the resin composition, and having a crystallization equilibrium time of 300 to 550 seconds.

29. The spacer as claimed in claim 21 wherein the resin matrix includes a resin composition comprising 53 to 71% by weight of a polyamide resin and 29 to 47% by weight of a crystalline polyolefin resin based on the weight of the resin composition, and having a crystallization equilibrium time of 350 to 420 seconds.

30. The spacer as claimed in claim 28 wherein the polyamide resin is at least one nylon selected from the group consisting of 6-nylon, 7-nylon, 11-nylon, 12-nylon, 6,6-nylon, 6,7-nylon, 6,10-nylon, 6,12-nylon, and xylylenediamine-lower aliphatic dicarboxylic acid copolycondensation nylon.

31. The spacer as claimed in claim 21 wherein the resin matrix comprises a crystalline polyolefin resin having at least one polymer selected from the group consisting of a crystalline propylene homopolymer and a crystalline propylene-α-olefin copolymer, said crystalline polyolefin resin having a MFR (230° C., 2.16 kgf) of not less than 10 g/10 min and a crystalline melting point (Tm) of 160° to 170° C.

32. The spacer as claimed in claim 31 wherein the α-olefin in the crystalline propylene-α-olefin copolymer includes ethylene.

33. The spacer as claimed in claim 21, wherein the shape ratio is in the range of 0.5 to 2.2 mm.

* * * * *